US008267743B2

(12) United States Patent
Schneider et al.

(10) Patent No.: US 8,267,743 B2
(45) Date of Patent: Sep. 18, 2012

(54) POLISHING HEAD AND TOOL CHANGE ARM FOR A POLISHING HEAD

(75) Inventors: Gunter Schneider, Marburg (DE); Helwig Buchenauer, Dautphetal-Buchenau (DE); Stephan Huttenhuis, Aachen (DE); Ulf Börner, Marburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 741 days.

(21) Appl. No.: 12/378,461

(22) Filed: Feb. 13, 2009

(65) Prior Publication Data

US 2010/0184361 A1 Jul. 22, 2010

(30) Foreign Application Priority Data

Jan. 20, 2009 (DE) ..... 20 2009 000 790 U

(51) Int. Cl.
*B24B 51/00* (2006.01)
*B24B 7/00* (2006.01)

(52) U.S. Cl. ..... 451/11; 483/33; 451/259

(58) Field of Classification Search ..... 451/11–13, 451/259, 559; 483/32–36, 38, 902, 30, 31
See application file for complete search history.

(56) References Cited

U.S. PATENT DOCUMENTS 3,451,125 A * 6/1969 Lehmkuhl ..... 483/34
4,414,732 A * 11/1983 Tomita et al. ..... 483/902
4,845,834 A * 7/1989 Watson ..... 483/34
4,879,802 A * 11/1989 Winkler et al. ..... 483/36

* cited by examiner

*Primary Examiner* — Hadi Shakeri
(74) *Attorney, Agent, or Firm* — Hudak, Shunk & Farine Co. LPA

(57) ABSTRACT

A polishing head for use in a polishing machine for optical surfaces, having an axis of rotation and a base body having a holding structure intended to be arranged at a polishing spindle and having a transport element intended to be held at a tool change arm, the transport element being positionable against a holding element of the tool change arm in order to perform a tool change, wherein at least one locking element is provided which can be positioned against the tool change arm such that a positive and/or non-positive joint results.

18 Claims, 3 Drawing Sheets

V-V

POLISHING HEAD AND TOOL CHANGE ARM FOR A POLISHING HEAD

FIELD OF INVENTION

The invention relates to a polishing head for use in a polishing machine for optical surfaces, comprising an axis of rotation and a base body having a holding structure intended to be arranged at a polishing spindle and having a transport element intended to be held at a tool change arm, the transport element being positionable against a locking element of the tool change arm in the axial direction relative to the axis of rotation in order to perform a tool change.

The invention also relates to a tool change arm of a polishing machine for optical surfaces, comprising a locking element intended to hold a polishing head having an axis of rotation, the locking element being positionable against a transport element of the polishing head in the axial direction in order to perform a tool change.

BACKGROUND OF THE INVENTION

A polishing head is already known from DE 10 2004 062 319 B3. This polishing head comprises a base body which supports a polishing pad on the one hand and can be fitted to a polishing spindle on the other. In order to perform an automatic tool change, the base body comprises a groove and a rim or a collar each of which extends over the circumference thereof. The groove and the collar are provided in order that the polishing head can be held by a tool change arm of the polishing machine. Between the base body and the tool change arm positioned in the groove or against the collar there is a positive joint acting in the axial direction which ensures that the polishing head can be changed, in particular that it can be fitted to the polishing spindle and removed from the polishing spindle.

The relative position in the circumferential direction between the polishing spindle and the polishing head to be fitted thereto is not known. The polishing head comprises driving lugs engaging with corresponding grooves of the polishing spindle. As a rule, the driving lugs do not yet engage with the grooves of the polishing spindle immediately after the polishing head has been fitted. Said engagement does not take place until the polishing spindle begins to rotate since then there is a relative movement in the circumferential direction between the polishing spindle and the polishing head to be fitted thereto. As soon as the driving lugs and the corresponding grooves are congruent with one another, the polishing head snaps into place under the influence of an axial mounting force exerted by the tool change arm.

SUMMARY OF THE INVENTION

The object of the invention is to design and arrange a polishing head and a tool change arm in such a way that an improved tool change is ensured.

According to the invention, this object is achieved by a polishing head and a tool changer according to the claims.

Since the polishing head is provided with at least one locking element which can be positioned against the tool change arm in the circumferential direction U such that a positive and/or non-positive joint results or since at least one guiding part is provided, which, in relation to the polishing head, can be positioned against the polishing head in the circumferential direction U relative to the axis of rotation such that a positive and/or non-positive joint results, movement of the polishing head in the circumferential direction relative to the tool change arm can be essentially avoided or at least highly restricted. When the tool spindle begins to rotate, there will in each case be the necessary relative movement in the circumferential direction between the polishing spindle and the polishing head to be fitted thereto. In order to ensure a relative movement in the circumferential direction between the polishing spindle and the polishing head to be fitted thereto, it is necessary the the positive and/or non-positive coupling between the tool change arm and the polishing head has a holding power of between 0.01 Nm and 0.2 Nm, between 0.02 Nm and 0.1 Nm or between 0.03 Nm and 0.08 Nm.

If the polishing head known from the state of the art is used, it can happen that the spindle begins to move, but the necessary relative movement in the circumferential direction between the polishing spindle and the polishing head to be fitted thereto does not take place or is at least insufficient. As a consequence, the polishing head or the driving lugs do not snap into place. The tool change arm is swung back automatically a certain time after the polishing spindle begins to rotate, which inevitably results in that the polishing head is lost if it has not snapped into place by then. The polishing process must be interrupted.

According to the invention, the polishing head is held fixed or at least braked in the circumferential direction relative to the tool change arm in order that the necessary relative movement between the polishing head and the polishing spindle can take place.

For this purpose it may also be advantageous if the locking element can be positioned or prestressed against the tool change arm in the radial direction relative to the axis of rotation and/or if the guiding part can be positioned and/or prestressed against a locking element of the polishing head in the radial direction relative to the axis of rotation. Said prestressing provides sufficient holding power in the circumferential direction. In addition, said prestressing ensures that the locking element and the guiding part can snap into place and, above all, disengage. In this way, the locking element can disengage or slip through if the polishing head is carried along by the polishing spindle, until the tool change arm is swung back.

Further, it may be advantageous if the locking element is formed as a depression or elevation of a surface of the base body or comprises a depression or elevation which, at least in the circumferential direction U, is limited to a partial circumference, a guiding part of the tool change arm being positionable in the depression or on the elevation, or if the guiding part is formed as a depression or elevation of a surface of the tool change arm or comprises a depression or elevation, the locking element of the polishing head being positionable in the depression or on the elevation. This ensures a simple positive coupling in the circumferential direction between the polishing head end the tool change arm. The locking element or the guiding part is finally more than a depression or elevation. As a whole, it ensures that the tool change arm and the polishing head will snap into each other, thus establishing a positive joint, and disengage.

It may also be advantageous if the locking element is formed as a continuous toothing, the guiding part of the tool change arm being able to be inserted or snap into the toothing, or if the guiding part is formed as a catch means and can be inserted or snap into and disengage from the locking element of the polishing head formed as a continuous toothing. The tooth spacing can be selected at will. The smaller the spacing of the teeth the higher is the wear of the locking element or the guiding part when the toothing slips through. The spacing of said catch means corresponds to said tooth spacing, the snapin action being ensured by said prestressing and by the positive joint acting in the circumferential direction.

The tooth spacing can be freely selected, between 1° and 90°, between 10°-60°, 36° or 40°.

Advantageously, the surface of the base body can be provided with a shoulder extending over the circumference U of the base body, the locking element being formed within the shoulder as a pitch-surface-shaped depression or elevation extending in the axial direction relative to the axis of rotation. The pitch-cylinder-shaped depression ensures sufficient holding power in the circumferential direction on the one hand and wear-free snapping into place and disengagement of the guiding part on the other. The pitch-surface-shaped depression extends in the axial direction and is open at the top and bottom relative to this direction so that a high tolerance is possible when the locking element and the guiding part are axially aligned.

It may be of special importance for the present invention if several locking elements are distributed over the circumference U, the guiding part of the tool change arm being positionable against one or more locking elements. A multiple coupling or toothing ensures that the specific holding power and/or prestressing force of each coupling or toothing is reduced and, as a result, less wear. There may be any number of locking elements. The number finally depends on the desired tooth spacing or spacing of the catch means. Four locking elements should at least be provided in order that the base body does not move too much between one locking or holding position and the next locking or holding position. Eighty locking elements would correspond to a tooth spacing of 4.5°. This number could serve as an upper limit. It is preferred that eight to twelve locking elements, particularly 10 locking elements, are provided.

It may further be advantageous if the transport element comprises a groove and/or a contact flange and extends over the circumference U of the base body. The groove and/or the contact flange ensure a positive joint acting in the axial direction between the polishing head and the tool change arm or the locking element. As a rule, the tool change arm comprises a fork- and collar-shaped holding element which is inserted in the groove in the radial direction. If in the inserted position a holding power acting in the radial direction is exerted, there will be a slight non-positive coupling acting in the circumferential direction which, however, does not ensure that the driving lugs will snap into place according to the invention.

BRIEF DESCRIPTION OF THE DRAWINGS

Further advantages and details of the invention are explained in the patent claims and in the description and shown in the figures, in which:

DETAILED DESCRIPTION OF THE INVENTION

Figure 1:
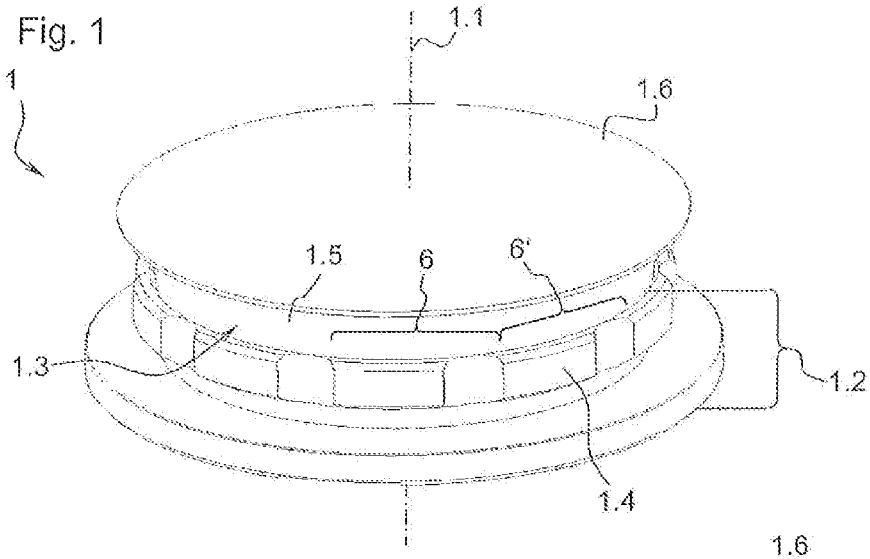
FIG. 1 shows a perspective view of a polishing head.

The polishing head 1 shown in FIG. 1 and the axis of rotation 1.1 comprise a base body 1.2 having an axis of rotation 1.1 on which a support part 1.5 for a polishing foil 1.6 arranged thereon is provided.

Figure 2:
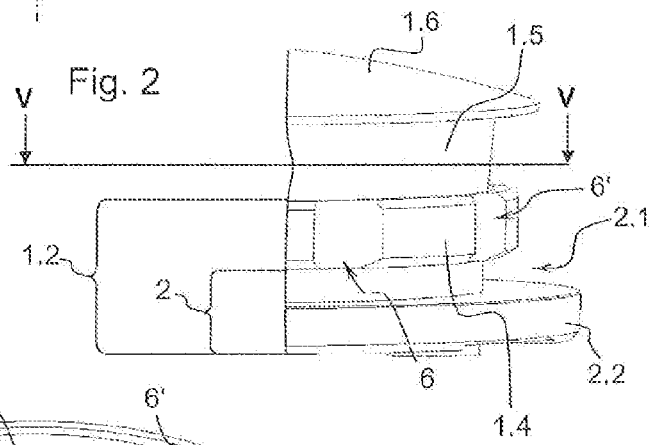
FIG. 2 shows a partial view of the perspective side view of the polishing head.

According to the side view of FIG. 2, the base body 1.2 comprises a shoulder 1.4 having several locking elements 6, 6' formed as a groove 2.1. In addition, the base body 1.2 comprises a fixing element 2 which is formed of a continuous groove 2.1 and a contact flange 2.2 adjacent thereto. The groove 2.1 results due to the shoulder 1.4 protruding from a surface 1.3 of the base body 1.2 in the radial direction on the one hand and due to the aforesaid contact flange 2.2 which itself protrudes from the surface 1.3 of the base body 1.2 in the radial direction on the other. As a rule, the support part 1.5 is made of an elastic material, such as foam material, on the end face of which a polishing foil 1.6 and, if required, holding means for the polishing foil 1.6 are provided.

Figure 3:
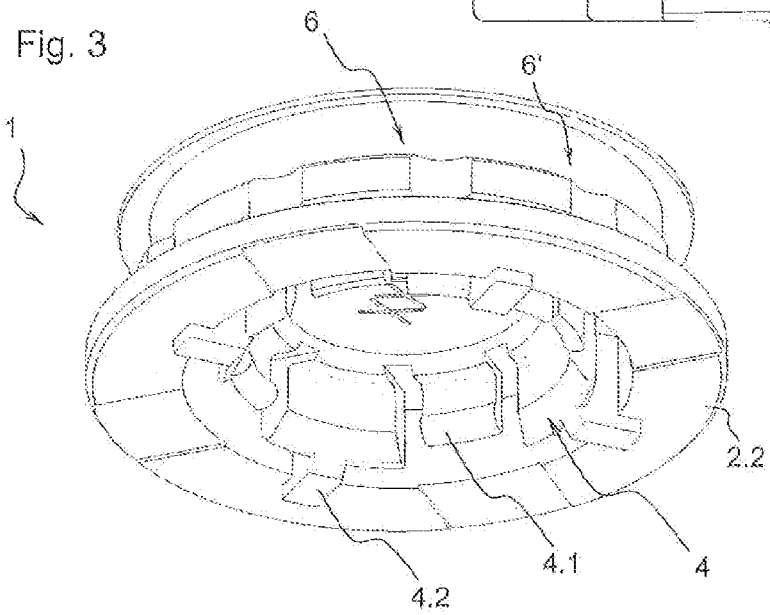
FIG. 3 shows a perspective view of the polishing head from below.
Figure 4:
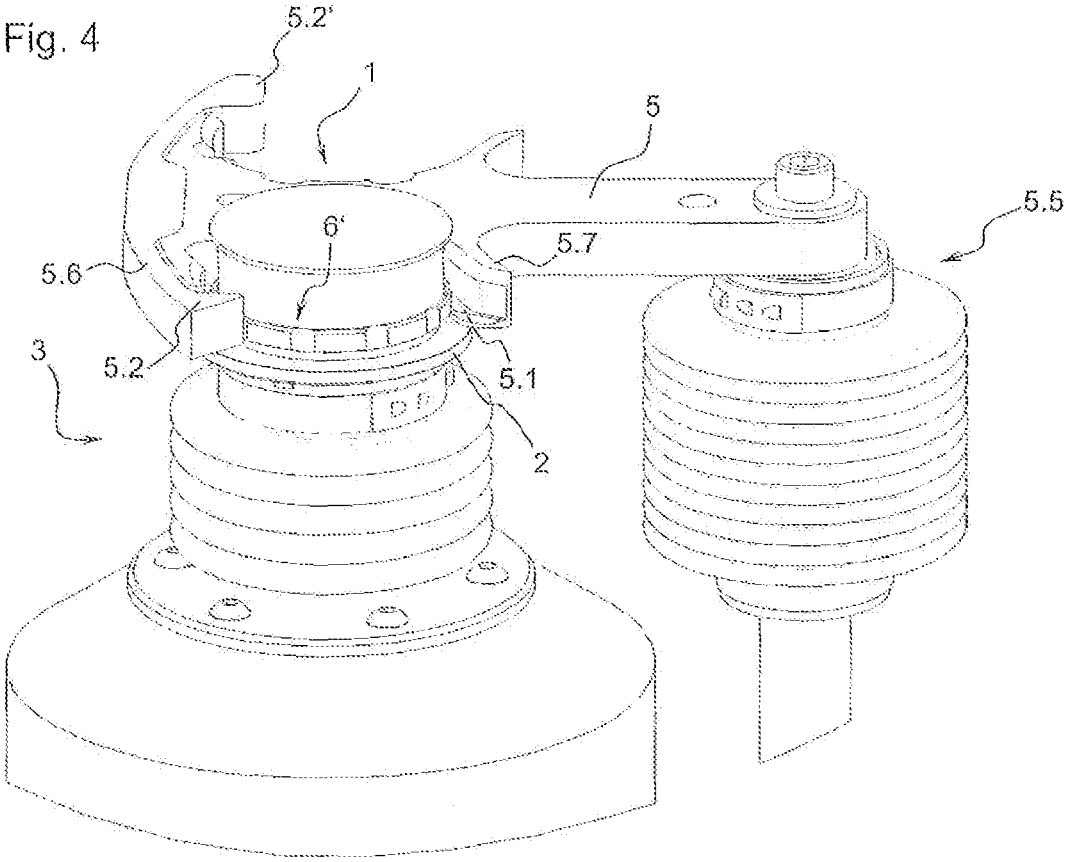
FIG. 4 shows a perspective view of the polishing head mounted on a polishing spindle, including a tool change arm.

According to the view of FIG. 3, the base body 1.2 comprises a holding structure 4 on its bottom side, which is essentially formed of several latches 4.1 and several driving lugs 4.2. By means of the holding structure 4, the polishing head 1 is fitted to a polishing spindle 3, as is shown in FIG. 4. The polishing spindle 3 comprises corresponding counter elements (not shown) which connect to the latches 4.1 or engage with the same on the one hand and are formed as grooves 2.1 which receive the driving lugs 4.2 on the other.

According to the view of FIG. 4, the polishing head 1 is fitted to the polishing spindle 3 by means of a tool change arm 5 having two legs 5.6, 5.7 forming a U shape. For this purpose, a holding element 5.1 of the tool change arm 5, which is arranged at the two legs 5.6, 5.7 and is also U-shaped and formed as a collar, engages with the groove 2.1 of the base body 1.2 in the radial direction so that a positive joint acting in the axial direction relative to the axis of rotation 1.1 results between the holding element 5.1 and the base body 1.2 or between the groove 2,1 and the contact flange 2.2. The tool change arm 5 is coupled to a lifting and swing shaft 5.5 which ensures that the tool change arm 5 can swing back and forth on the one hand and that the tool change arm 5 can move axially on the other in order to fit the polishing head 1 to the polishing spindle 3 or to remove the polishing head 1 therefrom.

Figure 5:
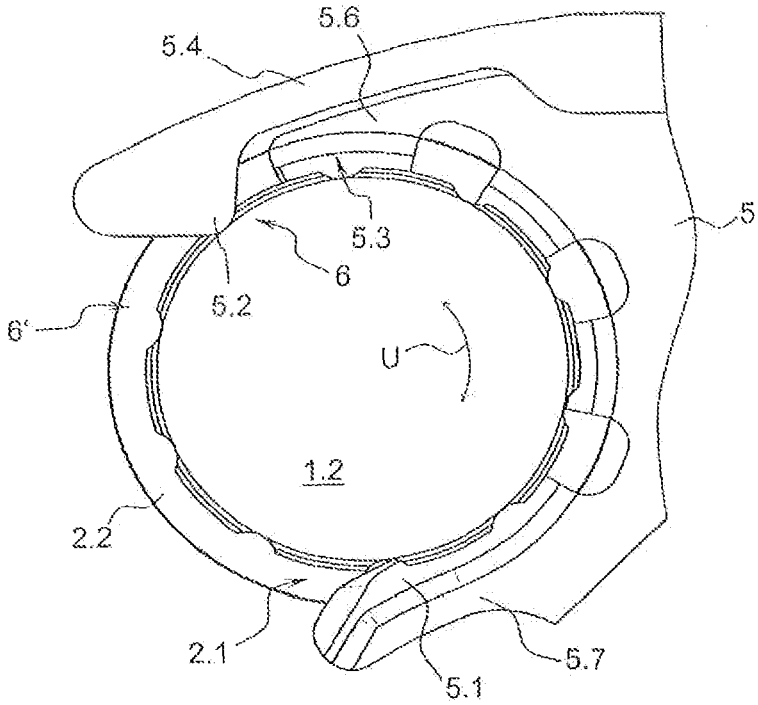
FIG. 5 shows a sectional view along V-V of the polishing head with tool change arm from above according to FIG. 2.

According to FIG. 5, i.e. a sectional view along V-V of FIG. 2, the tool change arm 5 comprises the cam-shaped holding element 5.1 and a guiding pad 5.2 which is positioned against or in a locking element 6 of the base body 1.2 or prestressed against the base body 1.2 by means of a spring element 5,4. The guiding part 5.2 is formed as a cam protruding from a surface 5.3 of the tool change arm 5 and engaging with or snapping into the locking element 6 formed as a groove so that a positive joint results in the circumferential direction U between the guiding part 5.2 and the base body 1.2 or the locking element 6. The spring element 5.4 is formed as a web and extends partially parallel to and spaced apart from the leg 5.6 and is not coupled to the tool change arm 5 but at the beginning of the leg 5.6. In this way, the spring action for the holding element 5.1 is ensured.

This positive joint acting in the circumferential direction U can be released in the case of excessive load by the guiding part 5.2 springing into place or by disengagement due to the prestressing spring element 5.4. Due to the relative movement, the guiding part 5.2 can then snap into the next locking element 6'.

Figure 6:
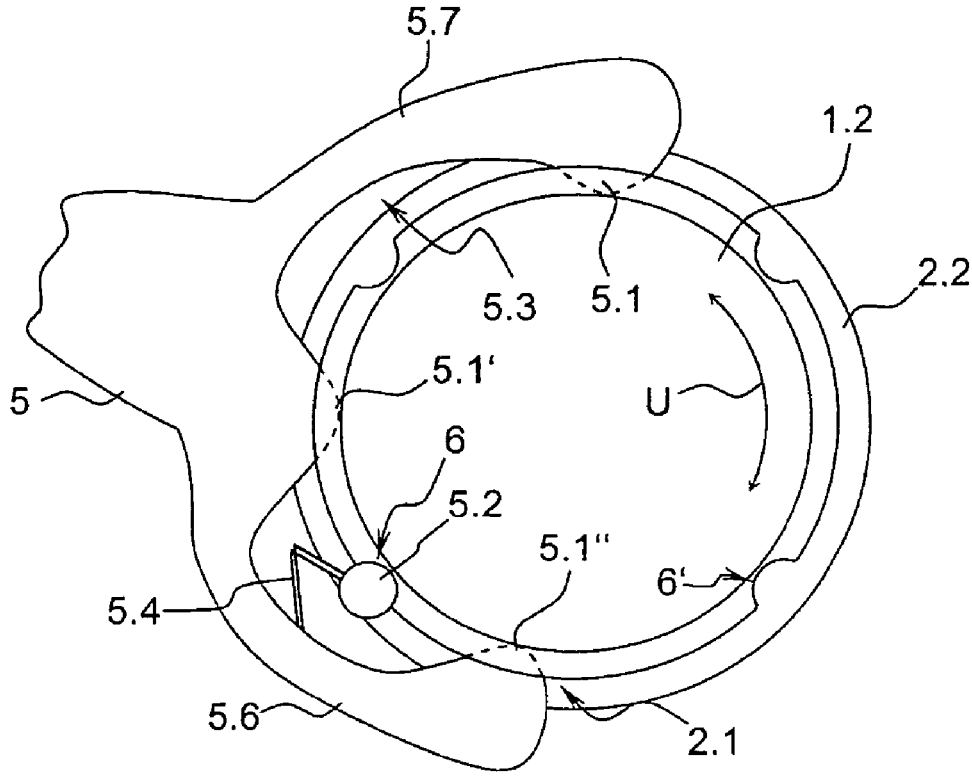
FIG. 6 shows an alternative of the tool change arm according to FIG. 5.

FIG. 6 shows an alternative embodiment of the tool change arm 5. The tool change arm 5 comprises a holding element divided into three parts 5.1, 5.1', 5.1" and a cylindrical guiding part 5.2 which is positioned against or in the locking element 6 of the base body 1.2, which is formed as a cylinder-shaped recess, or prestressed against the base body 1.2 by means of a spring element 5.4. The guiding part 5.2 protrudes from a surface 5.3 of the tool change arm 5 and engages with or snaps into the locking element 6 formed as a groove so that a positive joint in the circumferential direction U results between the guiding part 5.2 and the base body 1.2 or the locking element 6. The spring element 5.4 is arranged in the area between the leg 5.6 and the guiding part 5.2.

LIST OF REFERENCE NUMERALS

1 Polishing head
1.1 Axis of rotation
1.2 Base body
1.3 Surface
1.4 Shoulder
1.5 Support part
1.6 Polishing foil
2 Transport element
2.1 Groove
2.2 Contact flange
3 Polishing spindle
4 Holding structure
4.1 Latch
4.2 Driving lug
5 Tool change arm
5.1 Holding element, part
5.1' Holding element, part
5.1" Holding element, part
5.2 Guiding part
5.2' Guiding part
5.3 Surface
5.4 Spring element, web
5.5 Lifting and swing shaft
5.6 Leg
5.7 Leg
6 Locking element, depression, elevation
6' Locking element, depression, elevation
U Circumferential direction, circumference

What is claimed is:

1. A polishing head for use in a polishing machine for optical surfaces, comprising: an axis of rotation and a base body having a holding structure intended to be arranged at a polishing spindle and having a transport element intended to be held at a tool change arm, the transport element configured to contact a holding element of the tool change arm in the axial direction relative to the axis of rotation in order to perform a tool change, wherein the transport element is confiured to engage with two legs of the tool change arm forming a U shape and defining the holding element and a guiding part, at least one locking element is provided which is configured to contact the tool change arm such that the polishing head is in a circumferential direction U coupleable to the tool change arm such that when the polishing spindle begins to rotate, there is a necessary relative movement in the circumferential direction U between the polishing spindle and the polishing head to be fitted thereto, wherein the locking element is formed as a depression or elevation of a surface of the base body, which is limited to a partial circumference at least in the circumferential direction U, and is configured to receive the guiding part of the tool change arm in the depression or on the elevation.

2. The polishing head according to claim 1, wherein the locking element can be attached to the tool change arm in the radial direction relative to the axis of rotation, the attachment being prestressed or not.

3. The polishing head according to claim 1, wherein the locking element is formed as a continuous toothing, the guiding part of the tool change arm being able to be inserted or snap into the toothing.

4. The polishing head according to claim 1, wherein a surface of the base body comprises a shoulder extending over the circumference U of the base body, the locking element being formed within the shoulder as a pitch-surface-shaped depression or elevation extending in the axial direction relative to the axis of rotation.

5. The polishing head according to claim 1, wherein several looking elements are distributed over the circumference U, the guiding part of the tool change arm being positionable against one or more locking elements.

6. The polishing head according to claim 1, wherein the transport element comprises a groove or a contact flange or both the groove and the contract flange, and extends over the circumference U of the base body.

7. The polishing head according to claim 1, wherein the guiding part is formed as a depression or elevation of a surface of the tool change arm, the locking element of the polishing head being positionable in the depression or on the elevation of the guiding part.

8. The polishing head according to claim 7, wherein the guiding part is formed as a catch means and can snap into and disengage from the locking element of the polishing head formed as a continuous toothing.

9. The polishing head according to claim 1, wherein the polishing head in addition to the locking element has a holding structure on its bottom side adapted to be fixed to the polishing spindle, the holding structure having several latches and several driving lugs, the several driving lugs being coupleable to the polishing spindle.

10. A polishing machine with a polishing head for optical surfaces, comprising:

the polishing head; and a tool change arm, with the polishing head comprising an axis of rotation and a base body having a holding structure intended to be arranged at a polishing spindle and having a transport element holdable at the tool change arm, the transport element being positionable against a holding element of the tool change arm in the axial direction relative to the axis of rotation in order to perform a tool change, wherein the tool change arm includes two legs forming a U shape and defining the holding element and a guiding part, at least one locking element is provided which can be positioned against the tool change arm such that the polishing head is in a circumferential direction U coupleable to the tool change arm such that when the polishing spindle begins to rotate, there will in each case be the necessary relative movement in the circumferential direction between the polishing spindle and the polishing head to be fitted thereto, wherein the locking element is formed as a depression or elevation of a surface of the base body, which is limited to a partial circumference at least in the circumferential direction U, the guiding part of the tool change arm being positionable in the depression or on the elevation.

11. The polishing machine according to claim 10, wherein the guiding part is attachable to the locking element of the polishing head in the radial direction relative to the axis of rotation, the attachment being prestressed or not.

12. The polishing machine according to claim 10, wherein the locking element is formed as a continuous toothing, the guiding part of the tool change arm being able to be inserted or snap into the toothing.

13. The polishing machine according to claim 12, wherein the surface of the base body comprises a shoulder extending over the circumference U of the base body, the locking element being formed within the shoulder as a pitch- surface-shaped depression or elevation extending in the axial direction relative to the axis of rotation.

14. The polishing machine according to claim 13, wherein several locking elements are distributed over the circumference U, the guiding part of the tool change arm being positionable against one or more locking elements.

15. The polishing machine according to claim 14, wherein the transport element comprises a groove or a contact flange or both the groove and the contract flange, and extends over the circumference U of the base body.

16. The polishing machine according to claim 10, wherein the guiding part is formed as a depression or elevation of a surface of the tool change arm, the locking element of the polishing head being positionable in the depression or on the elevation of the guiding part.

17. The polishing machine according to claim 16, wherein the guiding part is formed as a catch means and can snap into and disengage from the locking element of the polishing head formed as a continuous toothing.

18. The polishing machine according to claim 10, wherein the polishing head in addition to the locking element has a holding structure on its bottom side adapted to be fixed to the polishing spindle, the holding structure having several latches and several driving lugs, the several driving lugs being coupleable to the polishing spindle.

* * * * *